US007686414B2

(12) United States Patent
Korem et al.

(10) Patent No.: US 7,686,414 B2
(45) Date of Patent: Mar. 30, 2010

(54) METHOD OF PRINTING ON LARGE FORMAT FLEXIBLE SUBSTRATE AND PRINTING APPARATUS

(75) Inventors: Aharon Korem, Herzlia (IL); Igor Yakubov, Netanya (IL); Yaron Dvori, Givataim (IL); Arnon Gani, Yavne (IL)

(73) Assignee: Hewlett-Packard Development Company, L.P., Houston, TX (US)

( * ) Notice: Subject to any disclaimer, the term of this patent is extended or adjusted under 35 U.S.C. 154(b) by 249 days.

(21) Appl. No.: 10/593,418

(22) PCT Filed: Mar. 23, 2005

(86) PCT No.: PCT/IL2005/000326

§ 371 (c)(1), (2), (4) Date: Nov. 14, 2007

(87) PCT Pub. No.: WO2005/094170

PCT Pub. Date: Oct. 13, 2005

(65) Prior Publication Data

US 2008/0259110 A1 Oct. 23, 2008

(30) Foreign Application Priority Data

Apr. 1, 2004 (IL) ..... 161210
Apr. 1, 2004 (IL) ..... 161211

(51) Int. Cl.
*B41J 29/393* (2006.01)

(52) U.S. Cl. ..... 347/19; 347/41

(58) Field of Classification Search ..... 347/12, 347/15, 41, 19, 43
See application file for complete search history.

(56) References Cited

U.S. PATENT DOCUMENTS 5,956,055 A * 9/1999 Gibson et al. ..... 347/40
6,532,026 B2 3/2003 Takahashi et al.
2006/0087529 A1 4/2006 Tayuki

* cited by examiner

*Primary Examiner*—Lamson D Nguyen

(57) ABSTRACT

Disclosed is a method of multi pass inkjet printing on wide format flexible substrates where errors in flexible substrate positions are corrected by adapting the geometry and position of the next printed swath to the geometry of the adjacent earlier printed image swath.

22 Claims, 13 Drawing Sheets

METHOD OF PRINTING ON LARGE FORMAT FLEXIBLE SUBSTRATE AND PRINTING APPARATUS

FIELD OF THE METHOD

The method relates to the field of inkjet printing and particularly to printing on large format flexible substrates.

BACKGROUND

Inkjet printing has gained popularity in a number of applications. One of the growing printing applications is printing of billboards, banners and point of sale displays. The ink-jet printing process involves manipulation of droplets of ink ejected from an orifice or a number of orifices of a print head onto an adjacent print substrate. Paper, vinyl, textiles, fabrics, and others are examples of print substrates. An ink-jet print head consists of an array or a matrix of ink nozzles, with each nozzle selectively ejecting ink droplets. Relative movement between the substrate and the print head enables substrate coverage and image creation. Each ink droplet comprises an image (picture) element, or "pixel." For the simplicity of explanation the term "print head" will be used for both single print head and a plurality or print heads organized on a common mechanical structure.

Good print quality requires printing resolution higher than the native spacing of nozzles of most commercially available print heads. In order to cover the substrate with the desired print resolution a single print head scans the substrate in a reciprocating type of movement a number of times or passes. Such multi pass printing method contributes to print quality and provides a better redundancy, since different nozzles participate in printing sections of the same line when scanning the substrate in a reciprocating type of movement.

A majority of billboards and banners having relatively large dimensions are printed on flexible substrates. Roll-to-Roll (R2R) printing machines are typically used for printing on flexible substrates. One of the drawbacks of the Roll-to-Roll printing machines is the low accuracy of the relative movement between such a wide flexible substrate and the print head. When pulled/moved flexible substrate easy stretches and deforms and accordingly changes its dimensions. This makes small, comparable with the printing resolution incremental movement of flexible substrate with accuracy of few microns nearly impossible.

BRIEF DESCRIPTION OF THE DRAWINGS

The foregoing and other objects, features and advantages of the method and of the apparatus will be apparent from the more particular description of the exemplary embodiments of the method and of the apparatus, as illustrated in the accompanying drawings in which like reference numbers refer to the same parts throughout the different figures. The drawings are not necessarily to scale, emphasis instead being placed upon illustrating the principles of the method.

DETAILED DESCRIPTION OF THE EXEMPLARY EMBODIMENTS

The principles and execution of a method and the operation and properties of an ink jet printing apparatus enabling the printing method may be understood with reference to the drawings and the accompanying description of non-limiting, exemplary embodiments.

Figure 1A:
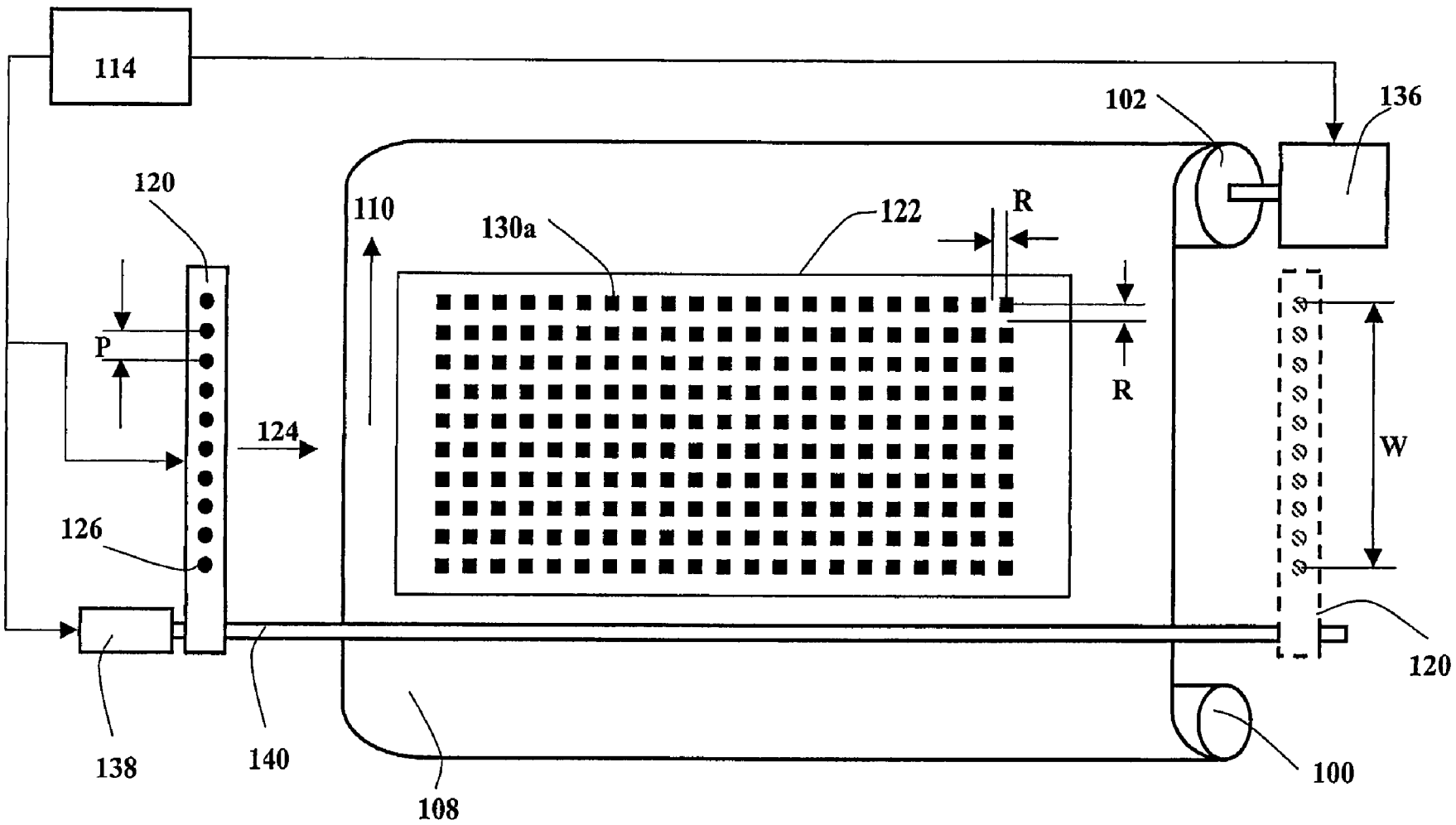
FIGS. 1A and 1B are schematic illustrations of an inkjet printer operating in a multi pass printing mode and a swath of an image printed by such a printer.
Figure 1B:
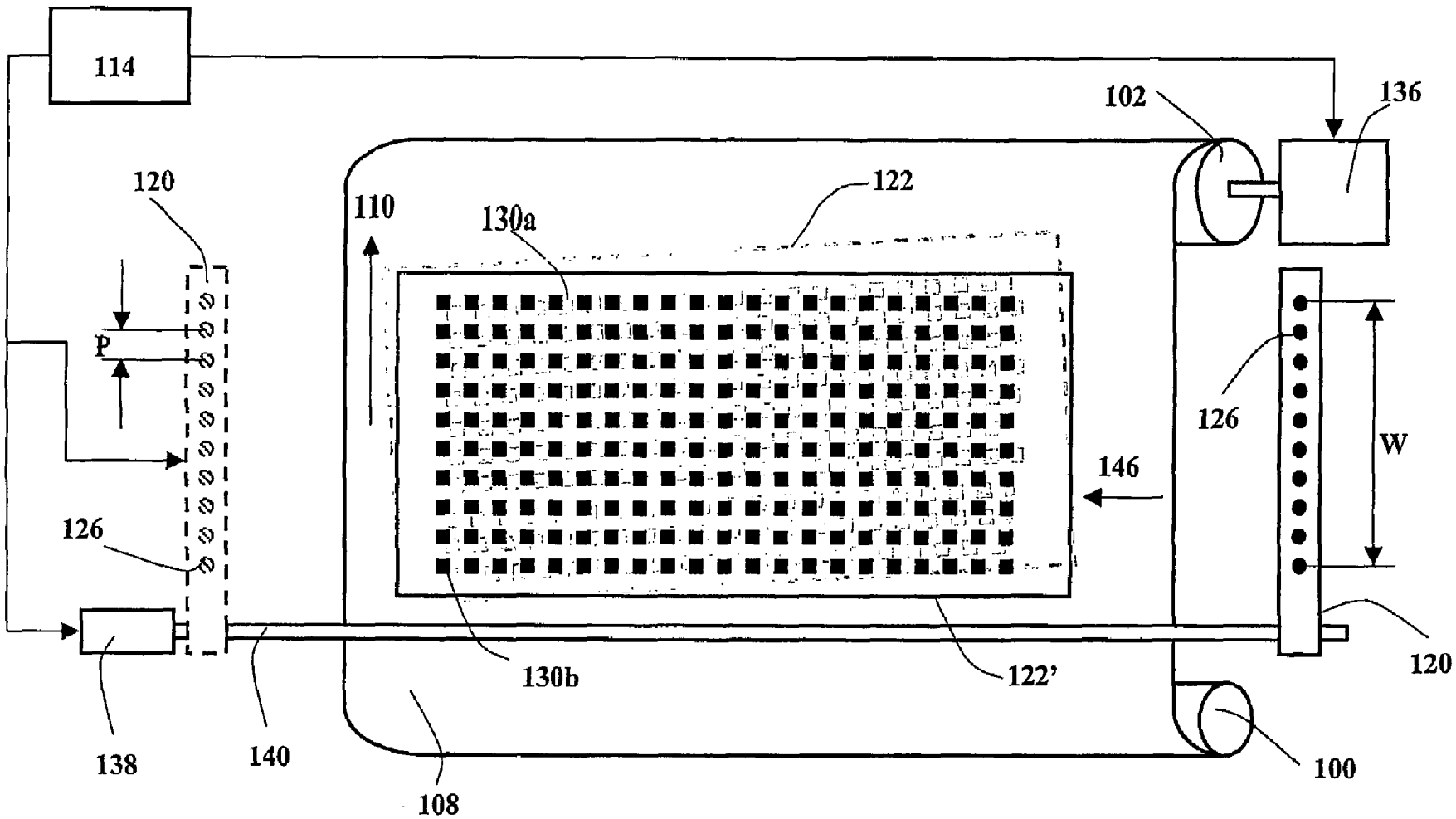

Reference is now made to FIGS. 1A and 1B which are schematic illustrations of an ink jet printer and a multi pass printing method. Print head 120 is printing an image consisting of a number of swaths and a particular print swath of the image bounded by lines of rectangle 122. Substrate 108 is advanced in the first direction indicated by arrow 110. Print head 120 scans in the second direction indicated by arrow 124 and each of nozzles 126 of print head 120 prints respective line shown as separate pixels (black squares) 130*a*. At the end of the scan, substrate 108 is advanced on a small, comparable with print resolution distance in the first direction indicated by arrow 110, print head 120 moves back (reciprocating type of movement) in the direction indicated by arrow 146 (FIG. 1B) and each of the nozzles 126 prints respective print line shown as separate pixels (black squares) 130*b*. The process continues until the swath bounded by lines of rectangle 122 is filled in. Print head nozzle pitch P is lower than the required print resolution R and in order to fill print swath bounded by lines of rectangle 122 the printing is performed in a multi pass mode. For the simplicity of explanation the printing resolution R is assumed to be equal in both first and second directions. The print head position is shown at the beginning of a scan/pass and the previous scan/pass is shown in lines and characters having lower density.

Other numerals on FIGS. 1A and 1B indicate: 114 is a control computer that controls operation of the printer, 100 and 102 are respectively media supply and receiving rollers, 136 and 138 are motors that provide movement to substrate-receiving roll 102, and print head 120 respectively; 140 is a linear guide on which print head 120 travels (scans) back and forth; 122' designates lines of rectangle that bounds print swath printed by print head 120 when it moves back (reciprocating type of movement) in the direction indicated by arrow 146.

As illustrated in FIG. 1B the incremental advance of substrate 108 having large dimensions and being flexible is not equal along print head scan path. When pulled or moved by any other moving means, wide size flexible substrate 108 stretches, skews and undergoes other types of distortions. These stretches and skews create visually disturbing banding effects known as printing artifacts shown in FIG. 1B.

FIGS. 1A and 1B illustrate a certain type of printed swath filling pattern in a multi pass printing mode introduced for exemplary purposes only. Since the relation between the native resolution of a print head and the printing resolution depends on the type of the print head, additional techniques for printed swath filling patterns in a multi pass printing mode exist. Even in cases where the print head resolution is equal to the printing resolution the printing is performed in a multi pass mode since multi pass printing methods contribute to print quality and provide a higher nozzle redundancy level. In multi pass printing different nozzles participate in printing of the same line when scanning the substrate in a reciprocating type of movement.

Figure 2A:
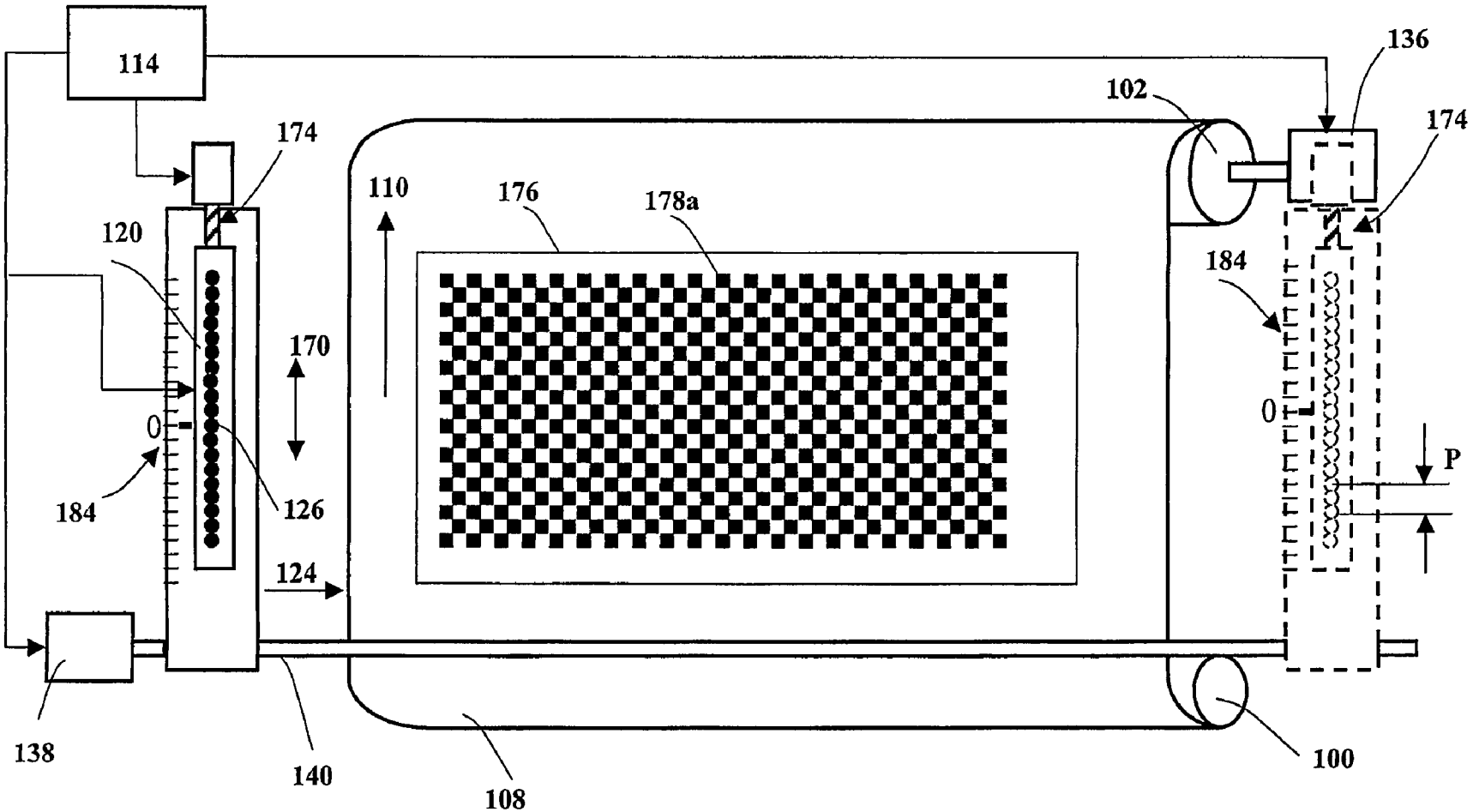
FIGS. 2A and 2B are schematic illustrations of an inkjet printer and an image printed by a multi pass printing method in accordance with the first exemplary embodiment of the method.

FIG. 2A is an illustration of an inkjet printer constructed in accordance with the first embodiment and a swath of a printed image printed by the printer. Print head 120 of the inkjet printing apparatus in addition to the capability of moving in the second direction indicated by arrow 124 may be moved in the direction (back and forth) indicated by arrow 170. Direction 170 is the direction in which substrate 108 moves and it is generally parallel to the first direction indicated by arrow 110.

Figure 2B:
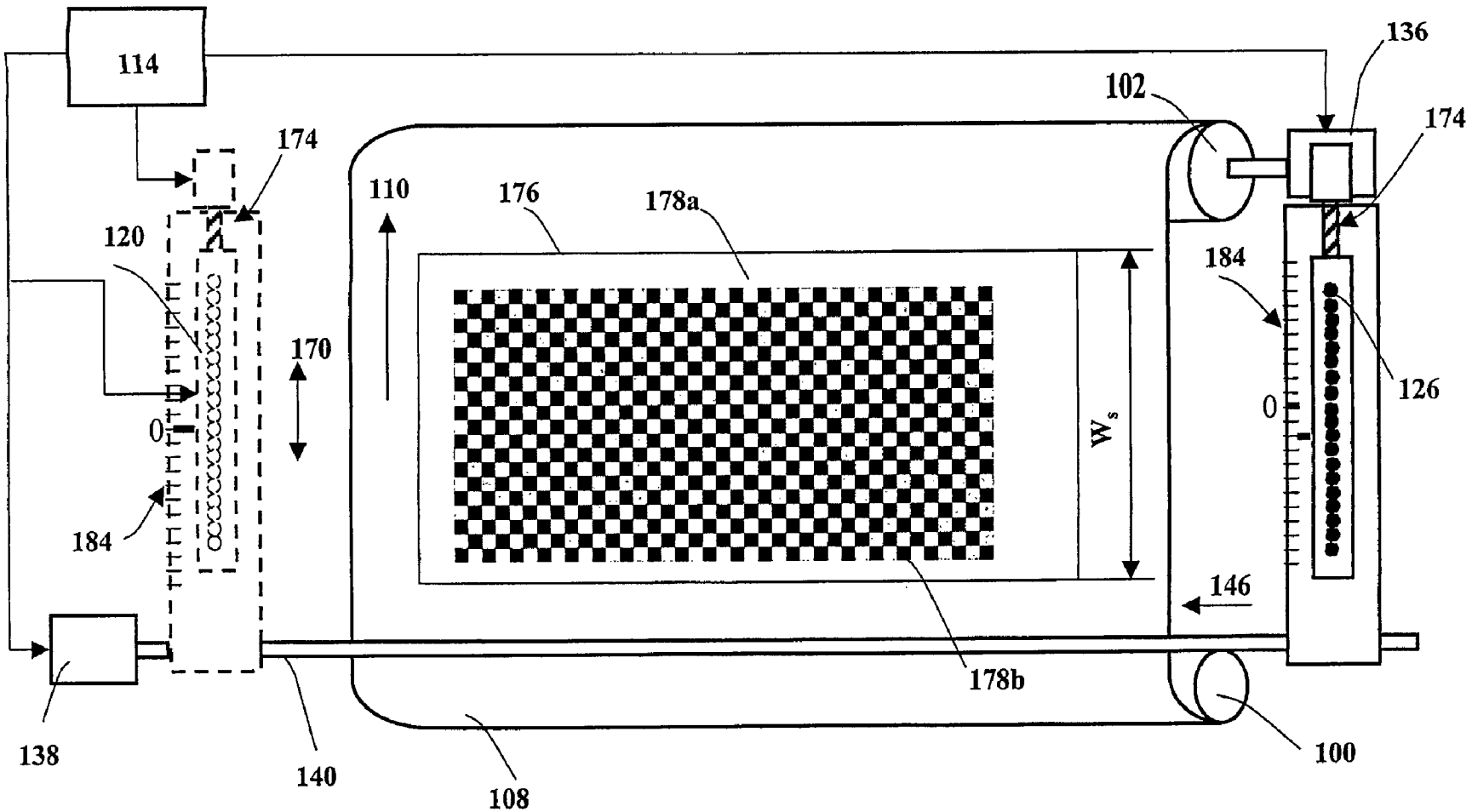

Mechanism 174 enabling print head 120 movement in the first direction indicated by arrow 170 may be a linear motor, a metal band or a linear guide with a drive screw. The particular shown mechanism 174 is a regular drive screw with a motor. Activation of the print head motor 138 moves print head 120 in the direction indicated by arrow 124 from one edge of substrate 108 to the second edge of substrate 108. In course of this movement print head 120 ejects ink droplets and prints a swath bounded by lines of rectangle 176. Each nozzle 126 of print head 120 prints a line of pixels 178*a*. In accordance with the first exemplary embodiment of the method for the purpose of filling-in printed swath 176 movement of print head 120 in the first direction replaces the small and not accurate incremental advance of flexible substrate 108. FIG. 2B shows printing of the next swath-filling scan. Substrate 108 remains static in the course of swath filling sequence. For printing pixel(s) 178*b* print head 120 was moved in the first direction indicated by arrow 170 on two digits as illustrated on scale 184. Scale 184 has been introduced for illustration purposes only. Following this print head moves back in the second direction indicated by arrow 146. Print head 120 movement in the first direction is relatively small and may be performed by rigid and accurate movement means, reducing printing artifacts caused by distortions of wide flexible substrate 108. Computer 114 distributes the swath filling information to be printed between successive passes. The particular multi pass swath-filling pattern has been shown for exemplary purposes only. Other swath filling patterns are possible.

Following completion of swath filling wide flexible substrate 108 advances on swath width (Ws) in first direction 110 and print head moving mechanism 174 returns print head 120 to the initial position. Other movement sequences where the print head is returned into the initial position for example, in course of the beginning of the next swath filling process, are possible. The division/split of the movement in the first direction between print head 120, that makes small and accurate incremental movements, and wide flexible substrate 108 that males coarse, swath wide movements, significantly reduces banding effects and associated with these movement printing artifacts. Control computer 114 controls the movement of print head 120 and the division/split of movements in the first direction between print head 120 and substrate 108.

Figure 3A:
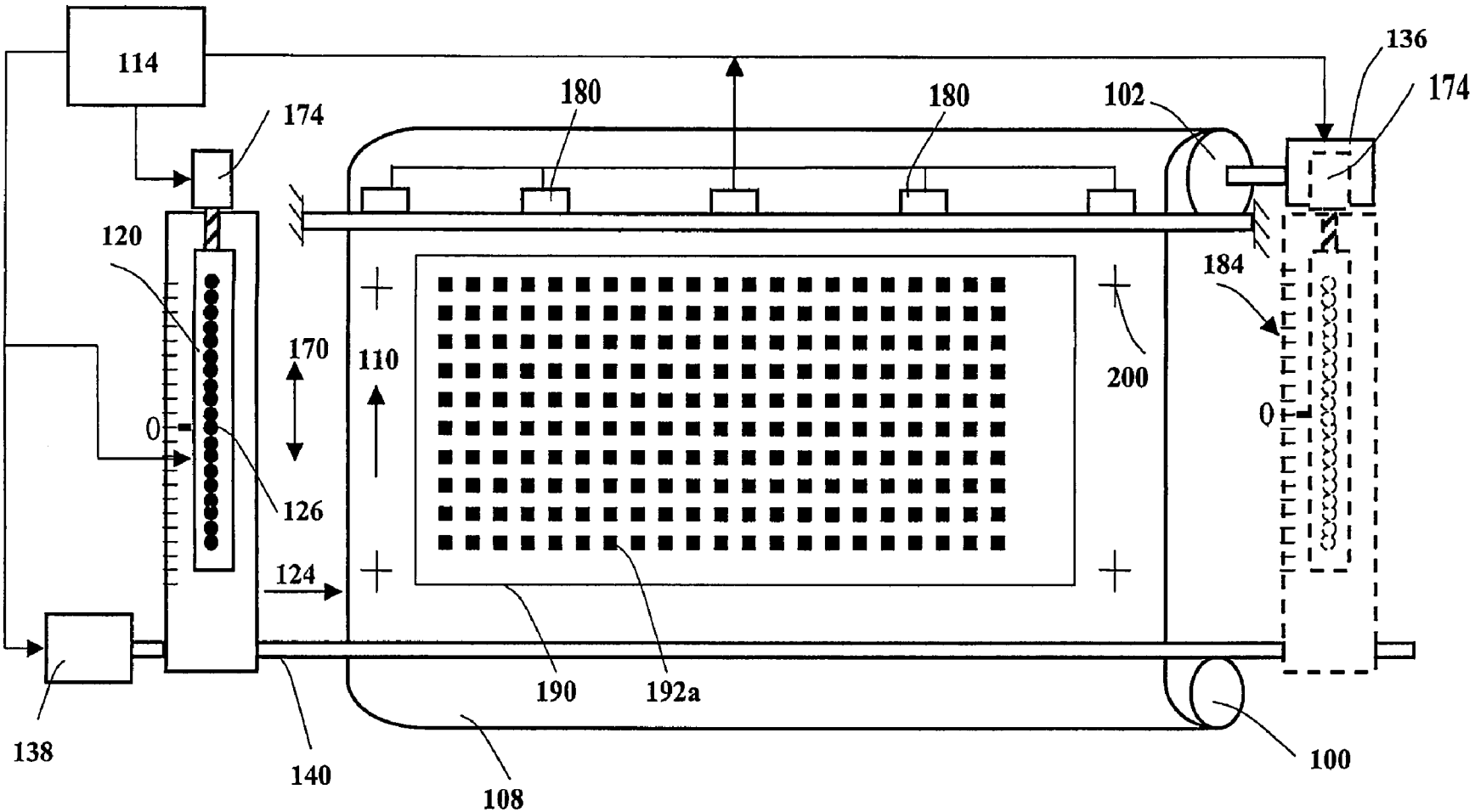
FIGS. 3A and 3B are schematic illustrations of an inkjet printer and an image printed by a multi pass printing method in accordance with the second exemplary embodiment of the method.

In accordance with the second exemplary embodiment of the multi pass ink jet printing method shown in FIG. 3A, inkjet printing apparatus in addition to print head 120 moving means 174 has image position detection means 180. Image position detection means 180 may be located along the second printing direction. Generally, image position detection means 180 should be of extended form to cover the whole width of printing substrate 108. Alternatively, image position detection means 180 may be positioned at predefined locations over substrate 108. Their position may be fixed or adjustable as appropriate for a particular machine design. Image position detection means 180 include a source of illumination and a detector. The source of illumination may be an incandescent lamp, a LED or a laser diode operating in visible or non-visible range of spectrum. The detector may be a photodiode, a quadrant detector, a CCD, or a video camera type detector. Magnetic detection means may be used also. Control computer 114 controls operation of image position detection means and of all units of the printer.

For printing, substrate-moving mechanism moves substrate 108 in the first direction indicated by arrow 110. Print head motor 138 with the help of moving mechanism moves print head 120 in the second direction indicated by arrow 124 from one edge of substrate 108 to the second edge of substrate 108. In course of this movement print head 120 ejects ink droplets and prints a swath bounded by lines of rectangle 190. The printing is performed in multi pass mode. Concurrently to printing a print swath of an image print head 120 prints in predefined positions control marks 200 shown, for exemplary purposes only, as crosses. Alternatively, an additional print head may be used to print the marks.

Following each successive multi pass swath print completion, wide flexible substrate 108 advances on the required distance in the first direction. This advance of wide flexible substrate 108 is not an accurate one, since deformations introduced into wide flexible substrate are not homogeneous across the width of substrate 108. Image on substrate position detecting means 180 detect and measure the coordinates of control marks 200, and communicate the coordinates of control marks 200 to control computer 114. Control marks 200 are indicators of the image on substrate position (and the position of substrate 108 itself). Control computer 114 uses the coordinates of control marks 200 to calculate the deviation of the current image or pixel position from the previous swath (image) position. Based on the measured current image position deviation control computer 114 calculates the required correction movement of print head 120 with respect to the previously printed swath.

In the course of print head 120 movement in the second direction indicated by arrow 146 print head moving mechanism 174 may perform continuous (dynamic) corrective movement of print head 120 in the first direction indicated by arrow 170. The corrective movement of print head 120 compensates for deformations and errors caused by wide format flexible substrate movement and reduces visible banding effects. Scale 184 is introduced for illustration purposes only. It shows the print head position at the beginning and end of the next swath bound by lines of rectangle 198. In this exemplary case the print head position was adjusted on one digit at the beginning of the scan and on two digits at the end of the scan. The trajectory of the continuous dynamic movement of print head 120 is shown by broken line 202 for illustration purposes only.

Figure 4A:
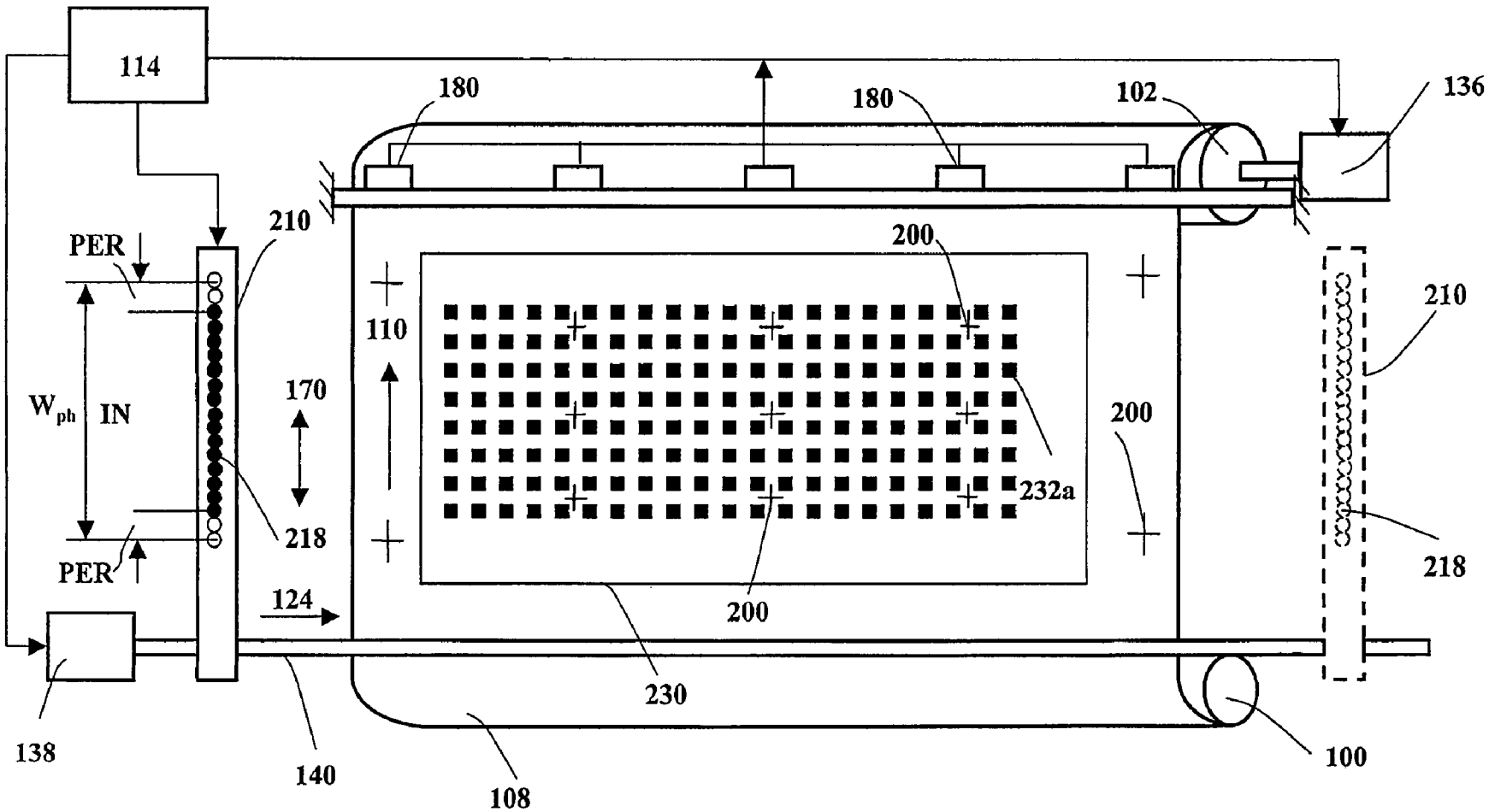
FIGS. 4A and 4B are schematic illustrations of an inkjet printer and an image printed by a multi pass printing method in accordance with the third exemplary embodiment of the method.

FIG. 4A is an illustration of the third exemplary embodiment of inkjet printer and a swath of an image printed by the printer. Ink ejecting nozzles 218 disposed along print head 210 width ($W_{ph}$) are virtually split into inner section nozzles (IN) and peripheral section nozzles (PER). In addition to this, the printer has image position detecting means 180 located along the second printing direction. Generally, image position detection means 180 should be of extended form to cover the whole width of printing substrate 108. Alternatively, image position detection means 180 may be positioned at predefined locations over substrate 108. Their position may be fixed or adjustable as appropriate for a particular machine design or type of printing and early detection of control marks. Control computer 114 controls operation of image position detectors 180 and of all units of the printer.

For printing, substrate-moving mechanism moves substrate 108 in first printing direction indicated by arrow 110. Print head moving mechanism moves print head 210 in the direction indicated by arrow 124 from one edge of substrate 108 to the second edge of substrate 108. In course of this movement each nozzle 218 of the inner nozzles section of print head 210 prints a line of pixels 232*a* of a swath bounded by lines of rectangle 230. The printing is performed in multi pass mode. In accordance with the present method concurrently to printing a print swath 230 of an image, print head 210 prints in predefined positions image position control marks 200. Control marks 200 may be printed on image free areas of the substrate, or on areas of the substrate occupied by an image.

Following each successive pass print, wide flexible substrate 108 advances on the required small distance in the first direction. This advance of wide flexible substrate 108 is not an accurate one, since deformations introduced into wide flexible substrate are not homogeneous across the width of substrate. In order to compensate for deficiencies of substrate moving mechanism, resulting in banding, image position detecting means 180 detect and measure the coordinates of control marks 200.

Image position detecting means 180 communicate the coordinates of image position control marks 200 to control computer 114. Image position control marks 200 are indicators of the actual image position (and the position of substrate itself). Control computer 114 uses the coordinates of control marks 200 to calculate the deviation of the actual image, or pixel position from the target or desired image position. Based on this deviation control computer 114 calculates the required correction data shift between the inner and peripheral nozzles of print head 210 with respect to the previously printed pass or swath.

Figure 4B:
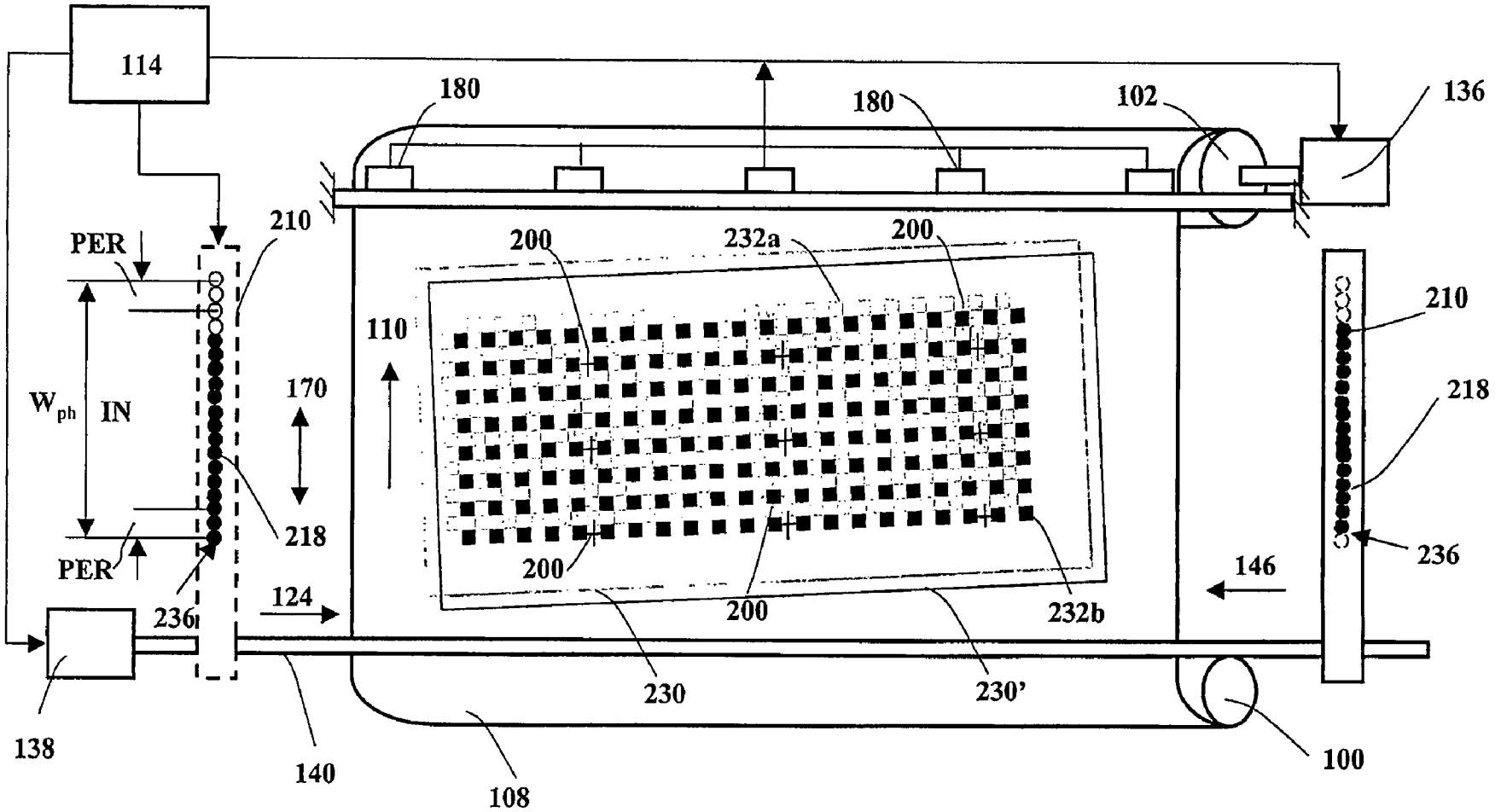

In accordance with the third exemplary embodiment of the method in the course of print head 210 movement in the second direction indicated by arrow 146 (FIG. 4B) continuous corrective data shift between inner and peripheral sections of nozzles takes place and peripheral nozzles become operative. The shift creates printed image position movement, which is generally parallel to first printing direction 110 and it corrects errors caused by substrate distortion by printing the image in a position adapted to the earlier printed image (swath, pass) position. The continuous corrective data shift compensates for deformations and errors caused by wide format flexible substrate movement and reduces visible banding effects. FIG. 4B shows that when print head makes the next scan moving in the direction of arrow 146 and printing pixels 232*b* the data shift has involved in printing one peripheral nozzle 236 (PER) at the beginning of the scan and two peripheral nozzles at the end of the scan as shown by numeral 236 introduced for illustration purposes.

Practically, the method of multi pass inkjet printing on wide format flexible substrates adapts the geometry and position of the currently printed swath (pass) to the geometry and position of the earlier printed adjacent image swath.

As illustrated in FIGS. 1 through 4 wide flexible substrates do not deform in a homogeneous way along their width or length and some areas of the printed image may have deformations larger than the others. In order to correct the printing artifacts caused by the non-homogeneous deformation of wide format flexible substrate along the printed swath control marks should be located along and across a printed swath enabling dynamic print head position correction. Control marks 200 may have any shape suitable for machine detection and convenient for deriving, based on the image position detector readings, the new position of flexible substrate 108. The size of control marks 200 is selected to enable reliable position detection without affecting image quality or content.

Figure 3B:
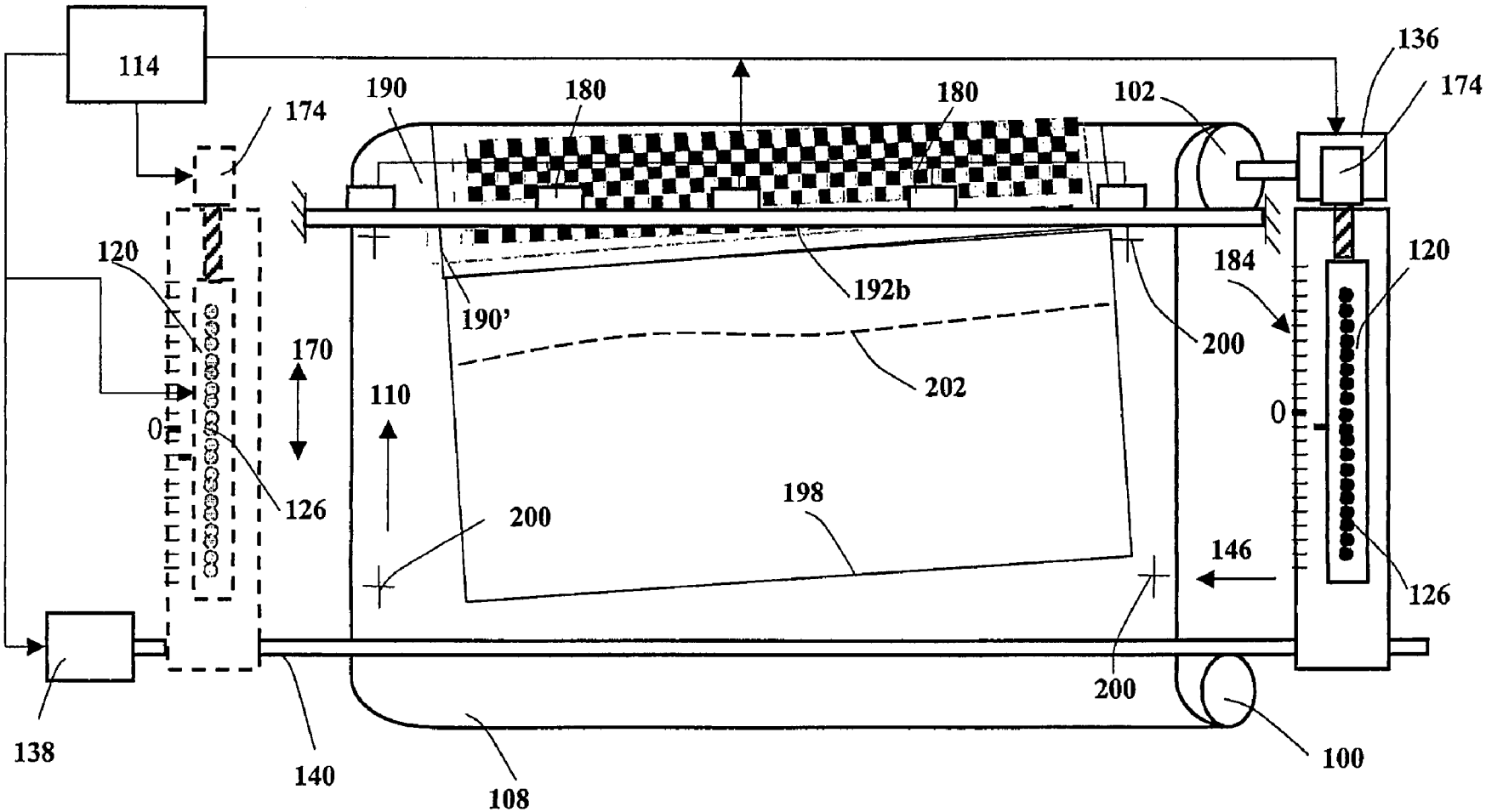

FIGS. 3 and 4 illustrate exemplary placements and form of control marks 200 along and across printed swaths 190 and 190', and 230 and 230'. When image position control marks 200 are located within the printed image their size and color should be selected in a way that does not create visual effects. This may be done by digital image analysis of the image that may be made before the swath is printed or concurrently with the swath printing process. The purpose of the analysis is to define proper position locations of image position control marks 200 within printed (image) swaths 190 and 230.

Figure 5:
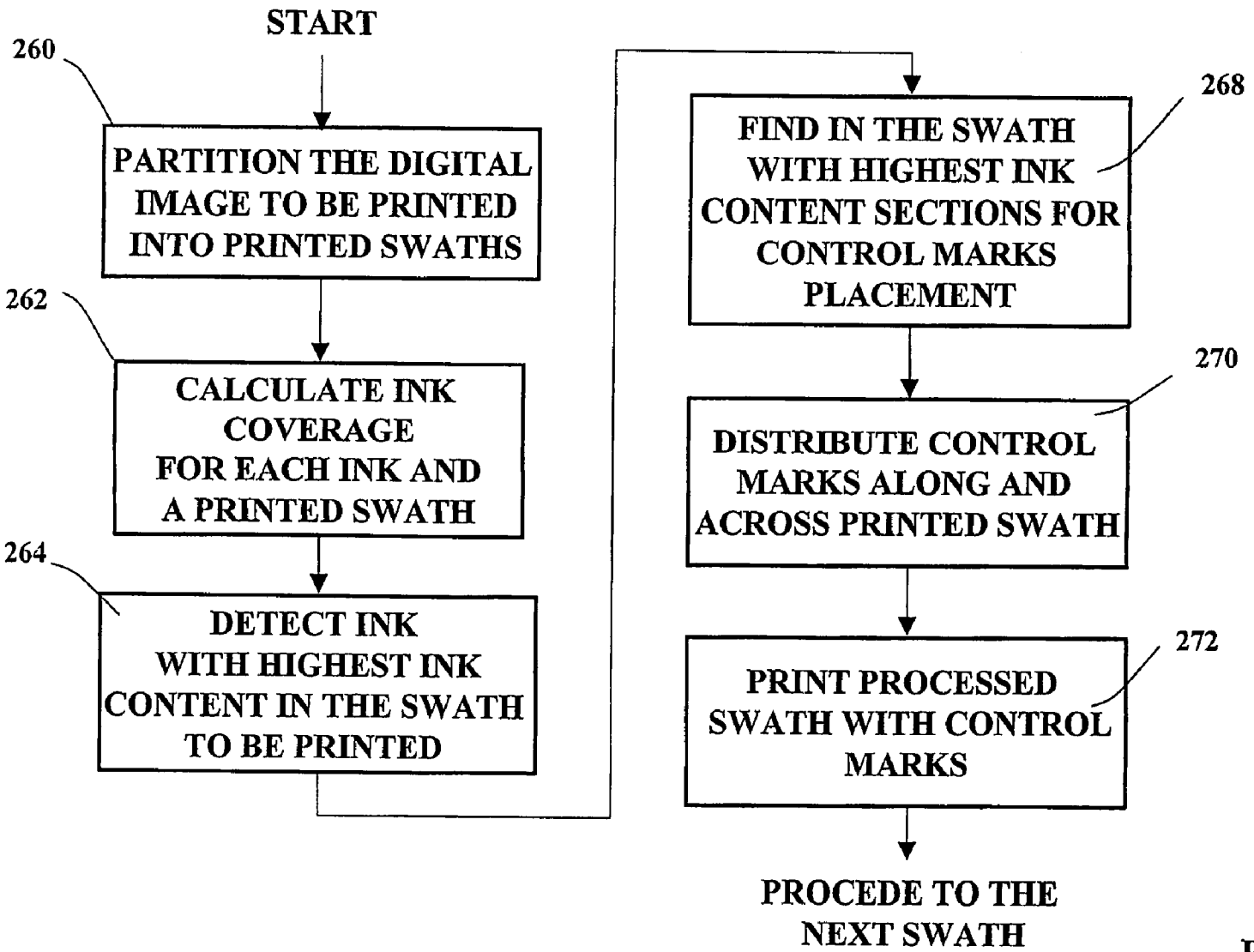
FIG. 5 is a simplified flow chart of image on substrate position control marks placement decision making algorithm.

FIG. 5 shows a simplified control marks 200 position location algorithm. Initially, (block 260) the digital image to be printed is partitioned into printed swaths and strips of image pertaining to the same swath are defined. Printing is usually performed in four process colors cyan, magenta, yellow and black (CMYK). The proportion of each of the process colors within each of the swaths is different and at block 262 ink coverage or content for a particular printed swath is calculated for each ink. Image position control marks 200 may be printed by a color (ink) that has largest coverage (proportion) in a particular swath. This ink is selected at block 264. Further to this position control marks printed when print head moves in the direction indicated by arrow 124 may be placed in places that will be overprinted by ink of the same color when print head 120 will move in the direction indicated by arrow 146. In order to find suitable control marks placement position within the image at block 268 swath with highest ink content is further analyzed for sections having clusters of inked pixels of sufficient size for marks placement.

Distribution of control marks along and across printed swath or within the printed image in a way that enables relatively smooth continuous print head position control takes place at step 270. The processed swath is printed simultaneously with image on substrate position control marks at step 272. The process continues in a similar way for the next swath. Alternatively, an additional print head may print marks 200.

Distribution of control marks along and across printed swath in a way that enables relatively smooth continuous print head position control within a single color (ink) may not always be possible. Highlight print areas may have not enough dense clusters for proper control marks positioning. In such extreme cases the control marks may be placed in more than one printing color (ink).

Alternatively, image position control marks may be printed by transparent ink or ink invisible to human eye, but easy detectable by image position detection means. Such marks may be printed in any location on the substrate and no special image processing is required. Such ink may be a clear ink Crystal UGE-05113 commercially available from Sun Chemicals (Sunjet), Fort Lee, N.J. U.S.A. Printing control marks by ink invisible to human eyes requires use of an additional print head. Alternatively, the marks may be printed by magnetic ink.

Figure 6:
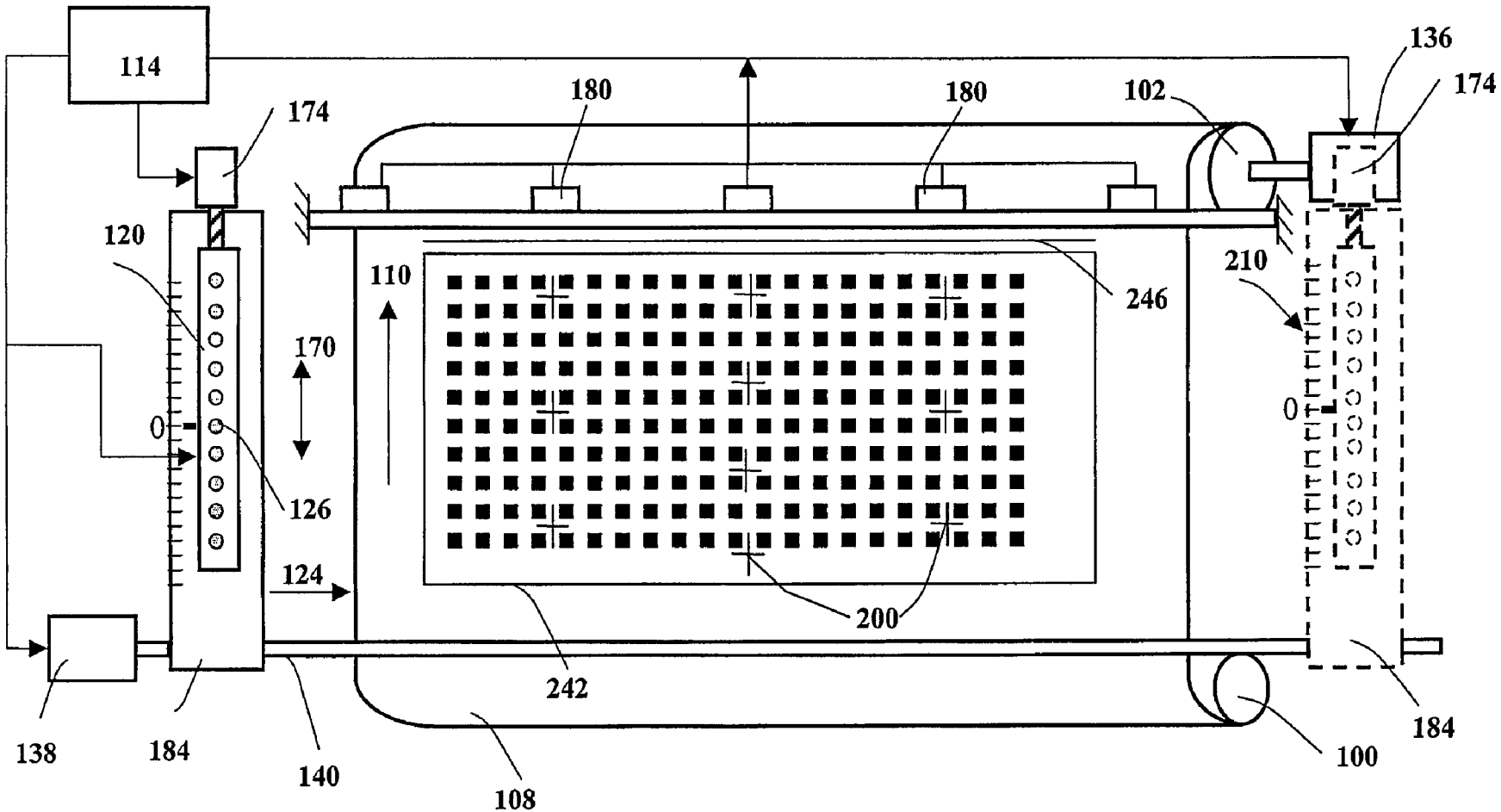
FIG. 6 is an illustration of the fourth exemplary embodiment of the multi pass printing method.

FIG. 6 shows the fourth exemplary embodiment of the method that provides another way of improvement of the printing accuracy and banding effects reduction. A line type mark 246 may be printed as the first line on image free area providing a reference for image on substrate position detectors operation. First printed swath 242 is aligned to this line. Location of image on substrate position detectors along the scanning path enables simultaneous reading of a large number of image on substrate control marks coordinates and provides means for making a practically smooth print head correction movement.

Figure 7A:
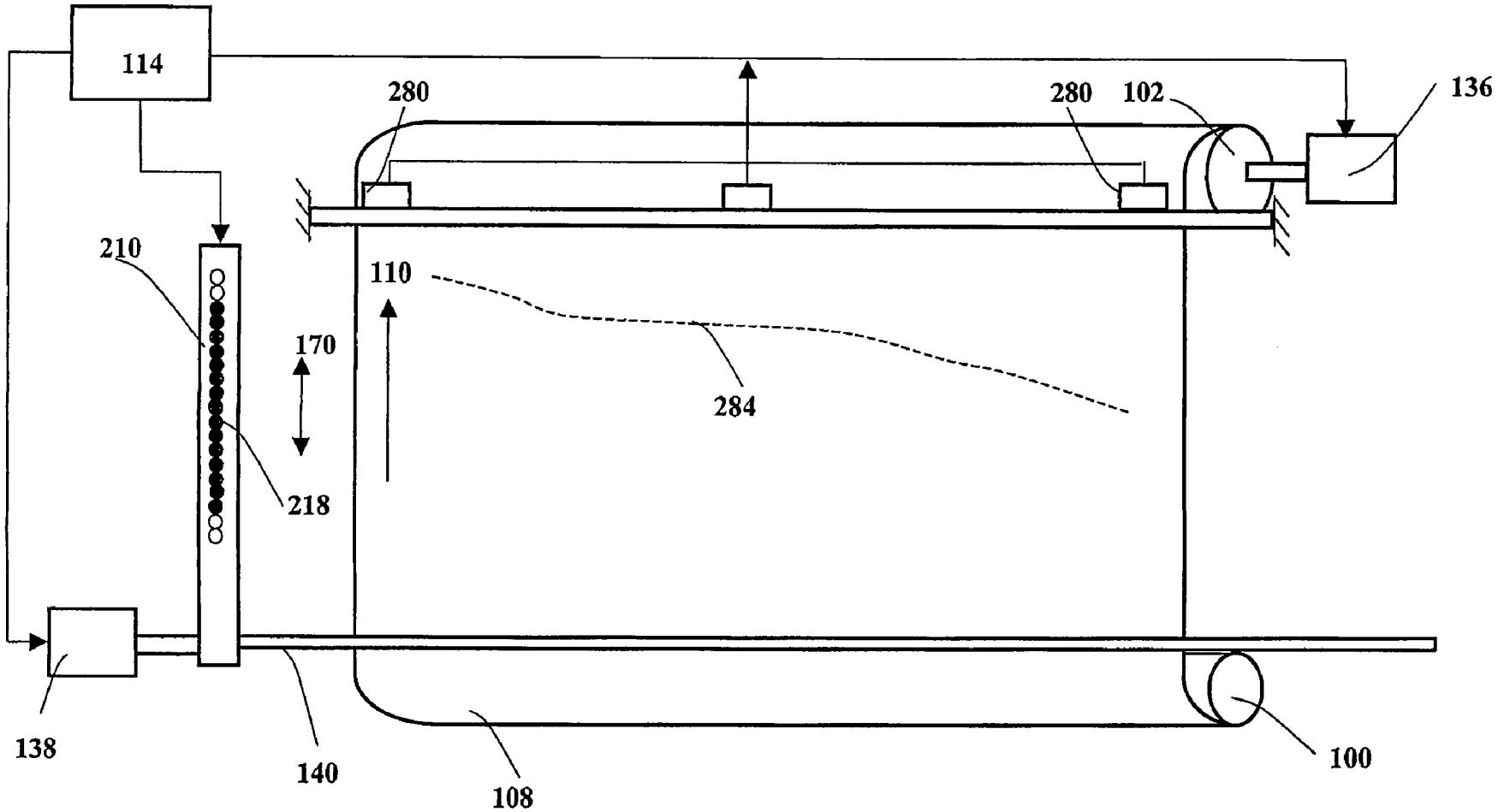
FIGS. 7A and 7B are illustrations of the fifth exemplary embodiment of the multi pass printing method.

Control marks 200 provide an effective tool for image position control. Monitoring the control marks coordinates (and accordingly the substrate position) and moving the print head or shifting the data in the same direction as the substrate moves achieves image position control and corrects printing artifacts caused by substrate distortions. FIG. 7A is a schematic illustrations of an inkjet printer constructed in accordance with the fourth exemplary embodiment of the present method. Printer of FIG. 7A is similar in structure to the printers of FIGS. 1-4, except that image position sensors 180 have been replaced by substrate position detection means 280, which may be optical mouse type sensors such as ADNS-2051 commercially available from Agilent Technologies, Inc. Palo Alto, Calif. 94303 U.S.A., or other similar sensors. Substrate position detection means 280 detect substrate distortions, schematically shown by phantom line 284, and associated with the distortions changes in printed image position. Substrate position detection means 280 are in communication with control computer 114 that receives substrate distortion coordinates and shifts accordingly the data to be printed between the inner nozzles section and peripheral nozzles section of print head 210 or moves print head 120 in the desired direction. The continuous corrective data shift compensates for deformations and errors caused by wide format flexible substrate movement and reduces visible banding effects.

Figure 7B:
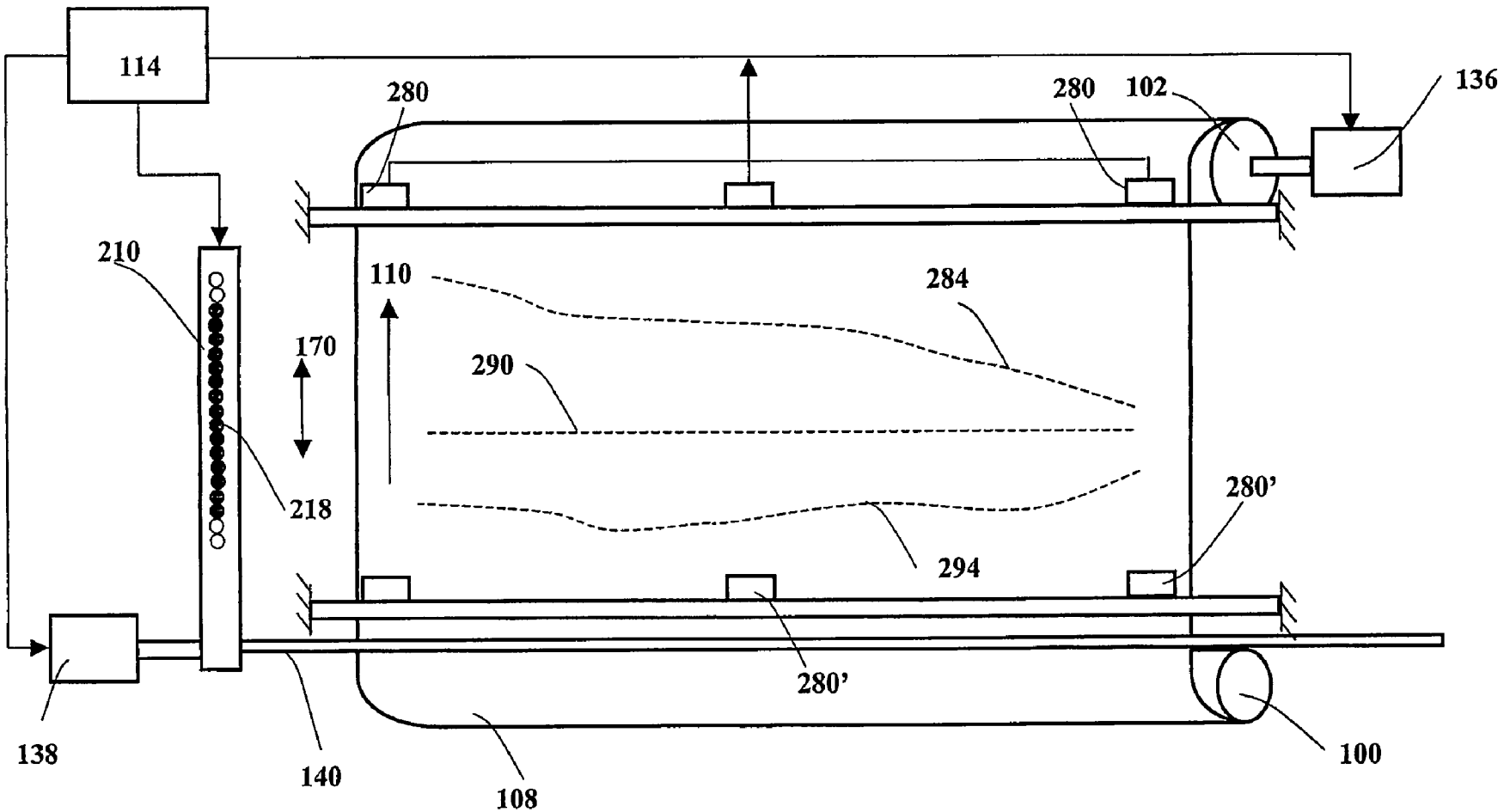

Wide format flexible substrate deformations, as shown in FIG. 7B by phantom lines 284 and 294, are non-homogeneous along the printed swath. There may be instances in which the edges of substrate 108 are deformed, but central section of substrate 108 marked by phantom line 290 is not deformed. Other types of substrate deformations are possible. A second set of substrate position detection means 280' disposed in a position allowing monitoring of the lower part of printed swath providing a more accurate correction value and accordingly the shift of data between inner and peripheral nozzles sections of print head 210, or moving print head 120 in the direction indicated by arrow 170. A variety of signal processing methods that are per-se not part of the method may be used to process the position signals provided by substrate position detectors 280 and 280'.

Figure 8:
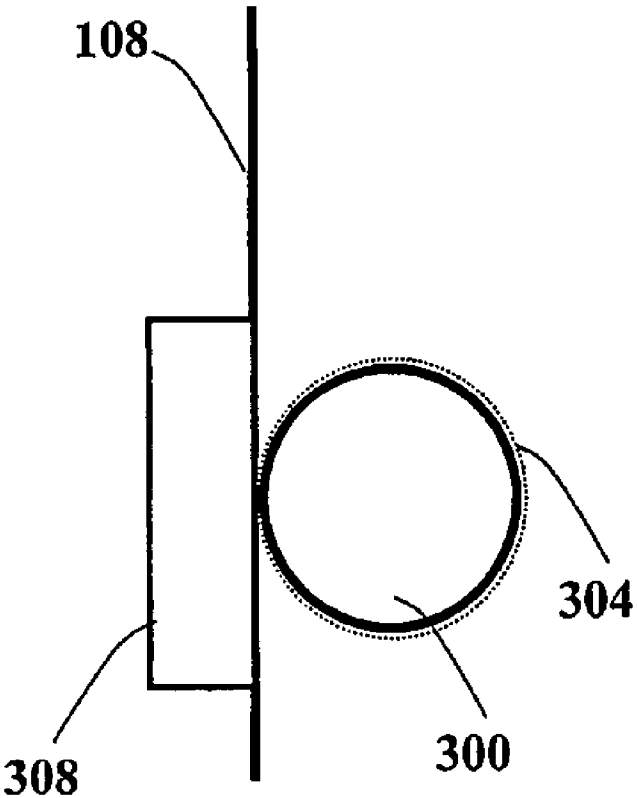
FIG. 8 is an illustration of contact metering means.

In an alternative embodiment non-contact substrate position detection means 250 may be replaced by contact substrate position detection means such as metering rollers that are in permanent contact with substrate 108. FIG. 8 shows such a metering roller 280 contacting substrate 108. In order to avoid any roller slippage the contact surface of roller 300 has an abrasive type coating 304. Roller 300 typically has certain preload and it may have some type of back support surface 308 that facilitates the metering process.

The exemplary embodiments illustrate so-called banding artifacts correction between the successive scans within the same print swath and corrections of the banding artifacts between two relatively wide printed swaths. The method is applicable to detection and compensation of missing lines and pixels providing a higher degree of redundancy in multi pass printing without using additional print heads.

Prints printed by the printer produce images of improved quality, as compared to existing printers. They do not exhibit banding effects. The width of printed substrate may be further increased without damaging print quality.

The above disclosure is intended as merely exemplary, and not to limit the scope of the invention, which is to be determined by reference to the appended claims.

What is claimed is:

1. An ink jet printing apparatus for printing an image on a wide format flexible substrate, comprising:

a substrate and a mechanism for moving the substrate in a first direction, a print head and a mechanism for moving the print head in a second direction, characterized in that said print head prints image position control marks concurrently with image printing and said image position control marks define a geometry and position of a printed swath of said image on said substrate, image position detecting means for detecting image on substrate position, and a control computer, characterized in that errors in said image on substrate positions are corrected by adapting the geometry and position of the currently printed swath to the geometry and position of the adjacent earlier printed image swath.

2. The apparatus of claim 1, characterized in that said image position detecting means measures the image on substrate position of a currently printed image relative to an earlier printed image swath.

3. The apparatus of claim 1, characterized in that the control computer calculates a deviation of the current image on substrate position relative to the previous swath position and generates an image position correction value.

4. The apparatus of claim 3, characterized in that for correction of said image position error said print head is moved in said first direction in accordance with said image position correction value.

5. The apparatus of claim 3, characterized in that for correction of said image position error image print data is shifted between inner and peripheral nozzles of said print head in said first printing direction in accordance with said image position correction value.

6. The apparatus of claim 1, characterized in that said print head places the image position control marks in places consisting of one of a group of image free areas and image areas.

7. The apparatus of claim 1, characterized in that said image position control marks are printed by ink consisting of one of a group of visible ink, invisible ink and magnetic ink.

8. An ink jet printing apparatus for printing an image on a wide format flexible substrate, comprising:

a substrate and a mechanism for moving the substrate in a first direction, a print head and a mechanism for moving the print head in a second direction, image position detecting means for detecting image on substrate position, and a control computer, characterized in that errors in said image on substrate positions are corrected by adapting the geometry and position of the currently printed swath to the geometry and position of the adjacent earlier printed image swath, characterized in that for correction of an image position error said print head is moved in said first direction in accordance with an image position correction value.

9. The apparatus of claim 8, characterized in that said image position detecting means measures the image on substrate position of a currently printed image relative to an earlier printed image swath.

10. The apparatus of claim 8, characterized in that the control computer calculates a deviation of the current image on substrate position relative to the previous swath position and generates said image position correction value.

11. The apparatus of claim 8, characterized in that for correction of said image position error image print data is shifted between inner and peripheral nozzles of said print head in said first printing direction in accordance with said image position correction value.

12. The apparatus of claim 8, characterized in that said print head prints image position control marks concurrently with image printing and said image position control marks define the geometry and position of said printed swath on said substrate.

13. The apparatus of claim 12, characterized in that said image position control marks are printed by ink consisting of one of a group of visible ink, invisible ink and magnetic ink.

14. The apparatus of claim 8, characterized in that said print head prints image position control marks concurrently with the image printing and places the image position control marks in places consisting of one of a group of image free areas and image areas.

15. The apparatus of claim 14, characterized in that said image position control marks are printed by ink consisting of one of a group of visible ink, invisible ink and magnetic ink.

16. An ink jet printing apparatus for printing an image on a wide format flexible substrate, comprising:

a substrate and a mechanism for moving the substrate in a first direction, a print head and a mechanism for moving the print head in a second direction, image position detecting means for detecting image on substrate position, and a control computer, characterized in that errors in said image on substrate positions are corrected by adapting the geometry and position of the currently printed swath to the geometry and position of the adjacent earlier printed image swath, characterized in that for correction of said image position error image print data is shifted between inner and peripheral nozzles of said print head in said first printing direction in accordance with said image position correction value.

17. The apparatus of claim 16, characterized in that said image position detecting means measures the image on substrate position of a currently printed image relative to an earlier printed image swath.

18. The apparatus of claim 16, characterized in that the control computer calculates a deviation of the current image on substrate position relative to the previous swath position and generates said image position correction value.

19. The apparatus of claim 16, characterized in that said print head prints image position control marks concurrently with image printing and said image position control marks define the geometry and position of said printed swath on said substrate.

20. The apparatus of claim 19, characterized in that said image position control marks are printed by ink consisting of one of a group of visible ink, invisible ink and magnetic ink.

21. The apparatus of claim 16, characterized in that said print head prints image position control marks concurrently with the image printing and places the image position control marks in places consisting of one of a group of image free areas and image areas.

22. The apparatus of claim 21, characterized in that said image position control marks are printed by ink consisting of one of a group of visible ink, invisible ink and magnetic ink.

* * * * *